US006045245A

United States Patent [19]

Kanou

[11] Patent Number: 6,045,245

[45] Date of Patent: Apr. 4, 2000

[54] VEHICULAR LAMP WITH SEPARATED PARABOLOID REFLECTIVE SURFACES

[75] Inventor: Hisaya Kanou, Shizuoka, Japan

[73] Assignee: Koito Manufacturing Co., Ltd., Tokyo, Japan

[21] Appl. No.: 09/089,671

[22] Filed: Jun. 3, 1998

[30] Foreign Application Priority Data

Jun. 4, 1997 [JP] Japan ..... 9-146175

[51] Int. Cl.[7] ..... F21U 7/00

[52] U.S. Cl. ..... 362/518; 362/346; 362/348; 362/517; 362/516

[58] Field of Search ..... 362/498, 499, 362/510, 516, 517, 518, 348, 346

[56] References Cited

U.S. PATENT DOCUMENTS

| | | | |
|---|---|---|---|
| 1,235,275 | 7/1917 | Wood | 362/518 |
| 1,600,271 | 9/1926 | Bishop | 362/518 |
| 1,610,025 | 12/1926 | Mentzer | 362/518 |
| 2,415,120 | 2/1947 | Whiting | 362/518 |
| 4,905,133 | 2/1990 | Mayer et al. | 362/346 |
| 4,916,585 | 4/1990 | Nino | 362/61 |
| 5,556,194 | 9/1996 | Natsume et al. | 362/299 |
| 5,582,481 | 12/1996 | Natsume | 362/336 |
| 5,876,114 | 3/1999 | Nino | 362/518 |

*Primary Examiner*—Sandra O'Shea
*Assistant Examiner*—John A. Ward
*Attorney, Agent, or Firm*—Morgan, Lewis & Bockius LLP

[57] ABSTRACT

Each of divided surfaces or regions of a reflector and its adjoining divided surface are continuous with each other by a continuous surface, and a diffusion surface for diffusing light is formed at the boundary portion between the divided surface and the continuous surface. Even when the light from a bulb does not reach the continuous surface, the light, diffused by the diffusion surface, covers the region of the continuous surface, thereby preventing this region from forming a stripe-like dim illuminating portion. A gently, convex-curved surface portion is formed at the boundary portion between the divided surface and the continuous surface, thereby further enhancing the light diffusion, and also preventing the stripe-like dim illuminating portion from being formed.

10 Claims, 7 Drawing Sheets

VEHICULAR LAMP WITH SEPARATED PARABOLOID REFLECTIVE SURFACES

BACKGROUND OF THE INVENTION

1. Field of the Invention

The present invention relates to a vehicular lamp for an automobile, and more particularly to a vehicular lamp of a thin design for an automobile.

2. Related Art

In a vehicular lamp for an automobile which is used as a tail lamp or the like of an automobile, a reflector, having a required surface (particularly, a paraboloid) , is used in order to form light, emitted from a bulb (serving as a light source) into required light distribution characteristics. However, in this reflector, its dimension in a direction of an optical axis is larger than a dimension of an opening, and as a result a dimension of the vehicular lamp in a forward-rearward direction is increased, which constitutes a barrier to a thin design of the vehicular lamp.

Therefore, there has heretofore been proposed a structure in which a reflective surface of a reflector is divided into a plurality of regions, and these divided surfaces are offset in a direction of an optical axis, thereby achieving a thin design of the reflector and hence a thin design of the vehicular lamp.

FIG. 9 shows one example of the conventional structure of the reflector. Aluminum or the like is vapor deposited on an inner surface of a lamp body 1A to form a reflector 6, and a bulb 5 is attached to the lamp body through a bulb socket 4 mounted in a bulb mounting hole 3 formed in a rear surface of the lamp body 1A. A lens 2 is mounted at a front opening in the lamp body 1A. A reflective surface of the reflector 6 is divided into a plurality of regions in a right-left direction, and each of these division regions defines a band-like divided surface 61 extending in an upward-downward direction, and these divided surfaces are offset a predetermined amount or different amounts rearwardly in the direction of the optical axis, and the divided surfaces 61 are interconnected to form one continuous reflective surface. Therefore, in this lamp body 1A, the overall dimension in the direction of the optical axis is reduced while the parabolic shape of each divided surface 61 is maintained, and light from the bulb 5 is reflected by the parabolic reflector, and the thin design of the reflector can be achieved.

In the conventional reflector, however, a relatively-sharp step portion 67 is inevitably formed at an interconnecting (continuous) portion where each two adjacent divided surfaces 61 are continuous with each other. FIG. 10A is a view showing the step portions 67 on an enlarged scale, and a surface (hereinafter referred to as "continuous surface") 62 of the continuous portion, formed between each two adjacent divided surfaces 61, is directed away from the direction of the light emitted from the bulb 5, and the step portions 67, forming a serrated cross-section, are formed by the continuous surfaces 62. Therefore, the light, emitting from the bulb 5, is intercepted by the step portions 67, and the bulb light is not applied to each continuous surface 62 and part of the divided surface 61 disposed outwardly adjacent thereto, and the amount of the reflected light is reduced or becomes almost zero at these portions, and when the vehicular lamp is seen from the front side thereof during the lighting, these continuous portions form stripe-like, dim illuminating portions, as shown in FIG. 10B.

On the other hand, the knife edge-like end of each step portion 67 intensely reflects the bulb light in one direction, and these portions form stripe-like illuminating portions brighter than the other portions. Therefore, the light distribution characteristics are such that the bright and dim illuminating portions are arranged in a striped manner, and the light distribution characteristics, providing a uniform light intensity, can not be obtained, and besides this detracts from the appearance.

In this kind of vehicular lamp, in some cases, one side portion thereof is curved along a side surface of a vehicle body to form a so-called round corner portion. If this round corner portion is formed when the reflector is constituted by the divided surfaces as described above, the bulb light-intercepting phenomenon, caused by the above-mentioned step portions, becomes more conspicuous, so that there is a possibility that the appearance of the vehicular lamp is further degraded by the stripe-like bright and dim illuminating portions at the round corner portion.

SUMMARY OF THE INVENTION

It is an object of this invention to provide a vehicular lamp for an automobile which is formed into a thin design, and in which the formation of bright-and-dim stripes is suppressed, thereby improving light distribution characteristics and the appearance. Another object of the invention is to provide a vehicular lamp for an automobile in which even if the vehicular lamp has a round corner portion, the degradation of light distribution characteristics at the round corner portion, as well as the degradation of the appearance, is improved.

According to the present invention, there is provided a vehicular lamp for an automobile in which a reflective surface of a reflector is divided into a plurality of regions, and each of divided surfaces is formed by a paraboloid, and a boundary portion between any two adjacent divided surfaces is formed as a diffusion surface. The formation of bright and dim stripes at the boundary portion between the divided surfaces is suppressed by the light diffusion due to the reflection of the light by this diffusion surface, thereby improving the light distribution characteristics and the appearance. Each of the divided surfaces and its adjoining divided surface can be made continuous with each other by a continuous, gently, convexly-curved surface, and the diffusion surface is formed at a distal end portion of the convexly-curved surface, and with this construction the formation of the bright and dim stripes can be more effectively prevented by the diffusion of the reflected light.

DESCRIPTION OF THE PREFERRED EMBODIMENT

Figure 1:
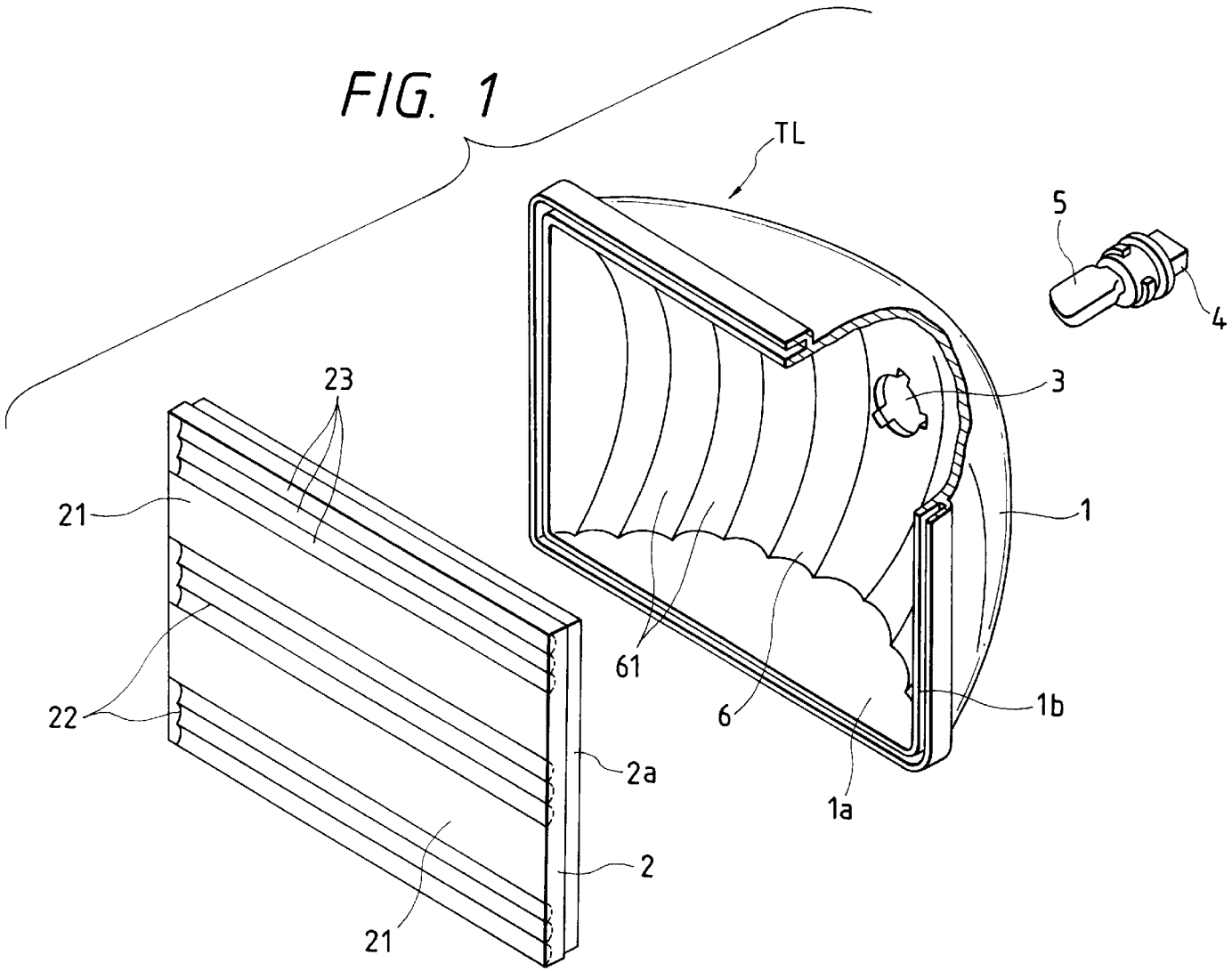
FIG. 1 is an exploded, perspective view of a first embodiment of a tail lamp of the present invention.
Figure 2:
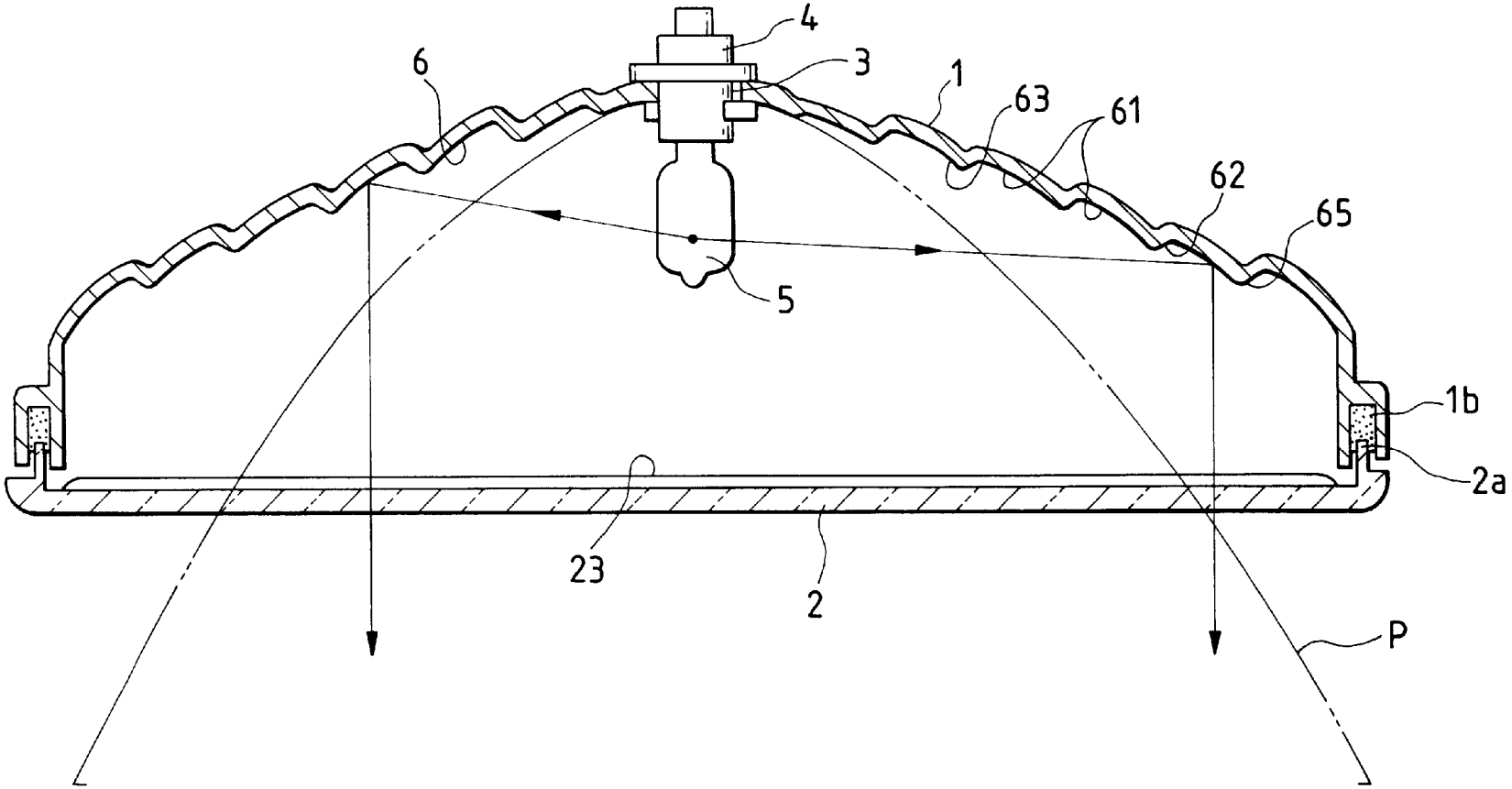
FIG. 2 is a horizontal cross-sectional view of the lamp of FIG. 1.

A preferred embodiment of the present invention will now be described with reference to accompanying drawings. FIG. 1 is an exploded, perspective view of a tail lamp of an automobile embodying the present invention, FIG. 2 is a horizontal cross-sectional view of the lamp in its assembled condition. The tail lamp TL includes a lamp housing which is constituted by a lamp body 1, molded of a synthetic resin, and a lens 2 mounted at a front opening 1*a* of the lamp body 1. A bulb mounting hole 3 is formed in a rear surface of the lamp body 1, and a bulb 5, supported by a bulb socket 4 fitted in the bulb mounting hole 3, is supported within the lamp body 1. Aluminum is vapor deposited on an inner surface of the lamp body 1, and the inner surface serves as a reflector 6 for reflecting light emitted from the bulb 5. A seal groove 1*b* is formed in and along a peripheral edge portion of the front opening 1*a* in the lamp body 1, and the lens 2 is secured to this peripheral edge portion in a sealed manner as described later.

The reflector 6 has a reflective surface which is formed generally into a paraboloid of revolution having its focus disposed on the light source bulb 5, and in the present embodiment, the reflective surface is divided into a plurality of regions in a right-left direction, and these regions respectively define a plurality of upwardly-downwardly extending, band-like divided surfaces 61 which are curved into a parabolic shape in the upward-downward direction, and are separated in the right-left direction to form narrow bands, so that the focal distances of the divided surfaces 61 gradually increase.

These divided surfaces 61 are offset toward the rear side of the lamp in a direction of an optical axis of the tail lamp TL, and particularly the outer divided surfaces of the lamp body 1 are offset a lager amount than the inner divided surfaces, and with the present structure the dimension of the plurality of divided surfaces 61 in the forward-rearward direction of the lamp is smaller than that of an ordinary paraboloid P indicated in a dots-and-dash line in FIG. 2, and therefore the overall thickness of the lamp is reduced.

Figure 3:
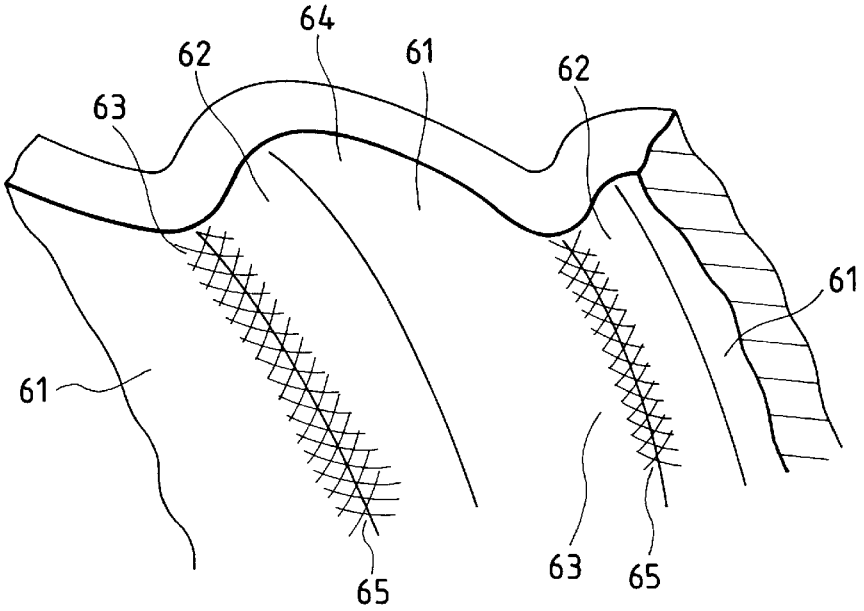
FIG. 3 is an enlarged, perspective view of a portion of a reflector of FIG. 1.

As shown in FIG. 3 which is an enlarged, fragmentary view, any two adjacent divided surfaces 61 is made continuous with each other by a continuous surface 62 provided at the boundary therebetween, and the plurality of divided surfaces 61 are made continuous with one another by these continuous surfaces 62 to form one continuous reflective surface, that is, the reflector 6. Further, that portion where each continuous surface 62 and its inwardly-adjoining divided surface 61 are continuous with each other is formed into a convex-curved surface portion 63 which is convex toward the front side as a whole. That portion where each continuous surface 62 and its outwardly- adjoining divided surface 61 are continuous with each other is formed into a concave-curved surface portion 64 which is concave toward the front side as a whole. Further, a fine pattern of recesses and projections (here, mesh-like recesses and projections) are formed on the surface of the convex-curved surface portion 63, and part of the surface of the convex-curved surface portion 63 serves as a diffusion surface 65. For forming the diffusion surfaces 65, for example, mesh-like cuts are beforehand formed in those portions of a mold (for molding the lamp body 1) corresponding respectively to these diffusion surfaces, and with this method, the corresponding portions of the reflector 6 of the resin-molded lamp body 1 are formed respectively into coarse surfaces each having the mesh-like recesses and projections formed by the cutting. Alternatively, there may be used a method in which after the reflector 6 is formed, the diffusion surfaces are formed by boarding or the like.

The lens 2 is molded of a transparent synthetic resin with a red color, and as shown in FIG. 1, the front side of the lens 2 is divided into a plurality of regions in the upward-downward direction, and these division regions comprise transmission portions 21 and lens step portions 22 which are alternately arranged. Each transmission portion 21 is formed as a transparent lens through which the interior of the lamp can be viewed. Each lens step portion 22 is constituted by a plurality of cylindrical lenses 23 which are juxtaposed in the upward-downward direction, and extend in the right-left direction, each cylindrical lens 23 having a small width in the upward-downward direction. The lens step portion 22 diffuses the light, transmitting therethrough, in the upward and downward directions.

A seal leg 2*a,* formed at its peripheral edge portion of the lens 2, is fitted in the seal groove 1*b* formed in the peripheral edge portion of the front opening 1*a* in the lamp body 1, and the lens 2 is fixed to this peripheral edge portion by retaining piece portions (not shown), and is secured thereto in a sealed manner by a sealant filled in the seal groove.

Figure 4A:
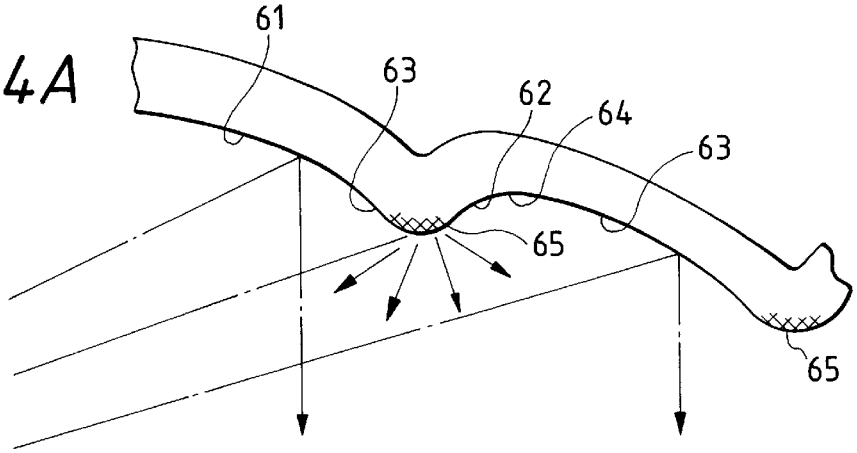
FIG. 4A is a view showing a condition of reflection of light by a portion of the reflector of FIG. 3.

In the tail lamp TL of this construction, the light, emitting from the bulb 5, is reflected by the reflector 6, and transmits through the lens 2 to be applied to the exterior, as shown in FIG. 2. In this case, the plurality of divided surfaces 61 of the reflector 6 are offset in the direction of the optical axis, and therefore the whole of the tail lamp is naturally formed into a thin design, and besides the divided surfaces 61 function respectively as reflective surfaces independent of one another, so that light-reflecting characteristics equivalent to that of a regular reflector can be obtained, and therefore the light distribution characteristics, required for the tail lamp TL, can be obtained. On the other hand, the light from the bulb 5 is reflected by the divided surfaces 61, but the bulb light is not projected directly onto the continuous surfaces 62 each interconnecting the two adjacent divided surfaces, and therefore the reflection will not occur at these portions. However, each continuous surface 62 and that portion of the divided surface 61, disposed inwardly adjacent thereto, jointly form the convex-curved surface portion 63, and part of this surface portion is formed as the diffusion surface 65, and therefore the bulb light, projected onto the diffusion surface 65, is reflected and diffused in the right and left directions, as shown in FIG. 4A.

Figure 4B:
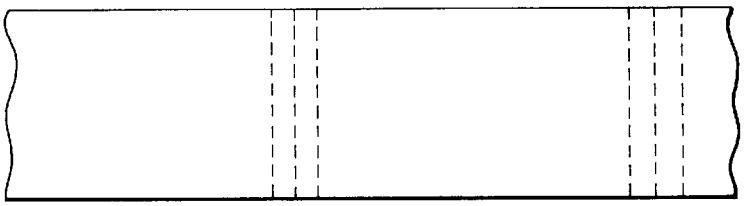
FIG. 4B is a view showing a condition of observation from the front side.

Therefore, the diffusion light, reflected by the diffusion surface 65 of the convex-curved surface portion 63, is diffused even to the region of the continuous surface 62, and therefore although the bulb light is not reflected by the continuous surface 62 as described above, a phenomenon, in which the continuous surface 62 forms a stripe-like, dim illuminating portion, is suppressed. And besides, each continuous surface 62 and that portion of the divided surface 61, disposed outwardly adjacent thereto, jointly form the concave-curved surface portion 64, and therefore the outline of a stripe-like, dim illuminating region at this portion is alleviated. Furthermore, the boundary portion between the continuous surface 62 and its inwardly-adjoining divided surface 61 is formed into the gently-curved surface by the convex-curved surface 63, and a knife edge-like step portion is not formed there, and therefore this portion will not become a stripe-like illuminating portion brighter than the other portions. Therefore, almost uniform light reflection can be achieved over the entire area of the reflector, and the desirable light distribution characteristics can be obtained as shown in FIG. 4B, and the appearance is prevented from being degraded.

In this tail lamp TL, the light, reflected by the diffusion surfaces 65 of the reflector 6 in the right and left directions, is diffused in the upward and downward directions by the cylindrical lens 23 of the lens step portions 22 when transmitting through the lens 2, and therefore the required upward-downward light distribution characteristics can be obtained, and the light distribution characteristics, required for the tail lamp TL, can be satisfied. The transmission portions 21 allow the light, reflected from the reflector 6, to pass directly therethrough, and therefore a design effect for the appearance of the tail lamp TL can be expected because of the difference in transmission characteristics between the lens step portions 22 and the transmission portions 21.

Figure 5:
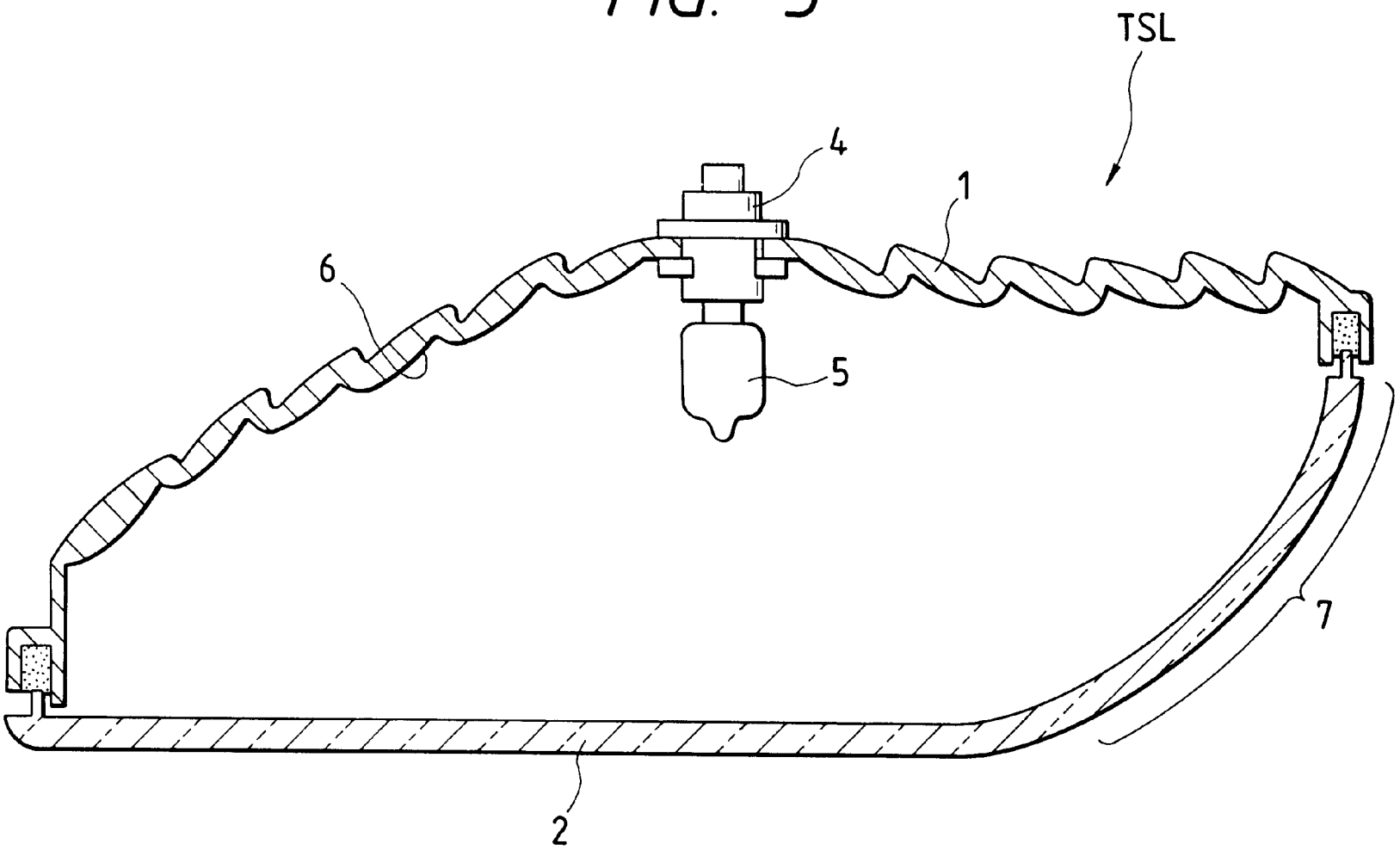
FIG. 5 is a horizontal cross-sectional view of a second embodiment of a turn signal lamp of the invention.
Figure 6:
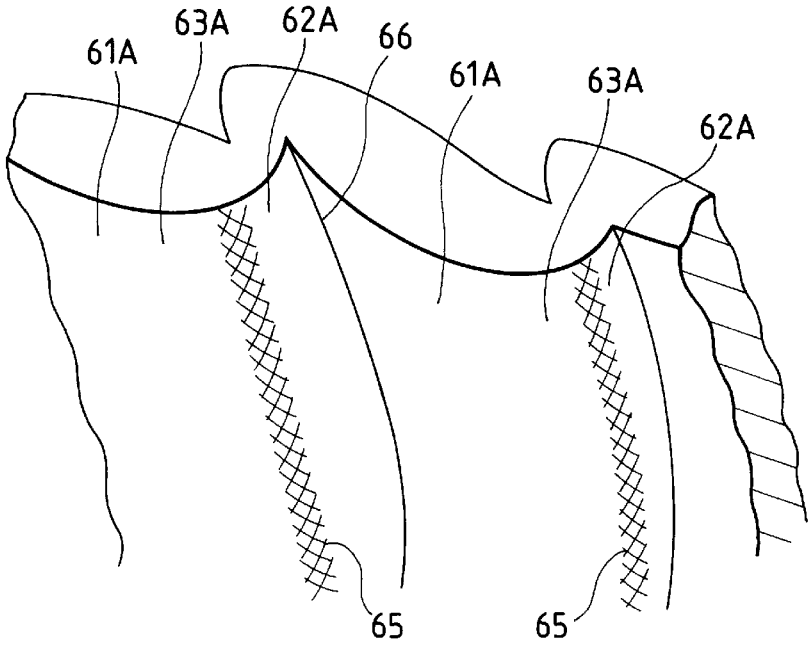
FIG. 6 is an enlarged, perspective view of a portion of a reflector of FIG. 5.
Figure 7A:
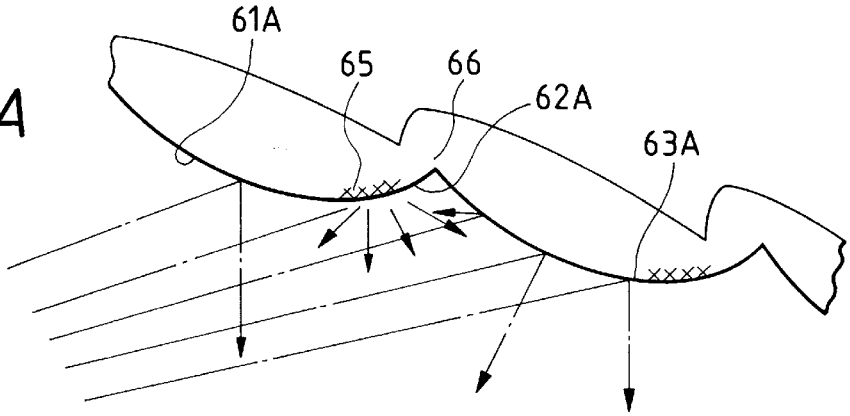
FIG. 7A is a view showing a condition of reflection of light by a portion of the reflector of FIG. 6.
Figure 7B:
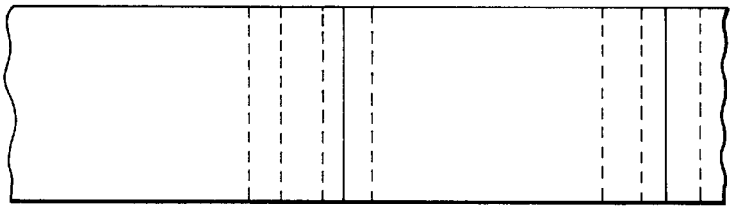
FIG. 7B is a view showing a condition of observation from the front side.

FIG. 5 is a horizontal cross-sectional view of a second embodiment of the present invention, FIG. 6 is an enlarged, perspective view of a portion of a reflector of FIG. 5, FIG. 7A is a view showing a condition of reflection of light by a portion of the reflector of FIG. 6, and FIG. 7B is a view showing a condition of observation from the front side.

In the second embodiment, the present invention is applied to a turn signal lamp TSL, and those portions equivalent to those of the first embodiment will be designated by identical reference numerals. In order to form a lamp body 1 into a thin design, this embodiment is identical to the first embodiment in that a reflector 6 is divided into a plurality of divided surfaces 61A each defined by a paraboloid, that the divided surfaces 61A are offset in a direction of an optical axis, and that the divided surfaces 61A are made continuous with one another by continuous surfaces 62A. In the present embodiment, those divided surfaces 61A, disposed on one side (left side in the drawings) of a bulb 5 close to a side surface of an automobile, are rearwardly offset a larger amount than those divided surfaces disposed on the other side. As a result, a surface region, constituted by these divided surfaces, is formed as a round corner portion 7 of the turn signal lamp TSL extending adjacent to the side surface of a vehicle body of the automobile. In this embodiment, as shown in FIGS. 6 and 7A, each continuous surface 62A and its inwardly-adjoining divided surface 61A are entirely convex toward the front side to jointly form one continuous convex-curved surface portion 63A, and as in the first embodiment, mesh-like recesses and projections are formed on the surface of the most projected portion thereof to form a diffusion surface 65. On the other hand, a step portion 66 of an acute angle is formed at the boundary between each continuous surface 62A and its outwardly-adjoining divided surface 61A.

The second embodiment is identical to the first embodiment in that the whole of the lamp body 1, including the round corner portion 7, can be formed into a thin design. In the reflector, the bulb light, projected onto each divided surface 61A, is reflected and diffused in right and left directions by the curved configuration of the convex-curved surface portion 63A, and also the bulb light is reflected by the diffusion surface 65, formed on the surface of the convex-curved surface portion 63A, in a markedly-diffused condition. Therefore, at the round corner portion 7, the amount of rearward offset of the outwardly-disposed divided surfaces 61A is large, and the step portion 66, formed at the boundary between the divided surface 61A and the continuous surface 62A, is conspicuous, but this step portion 66 is covered by the diffusion of the bulb light, thereby preventing the step portion 66 from looking dim. As a result, as shown in FIG. 7B, stripe-like bright and dim illuminating portions are prevented from being formed at the whole of the turn signal lamp TSL including the round corner portion 7, and the desirable light distribution characteristics and the good appearance can be obtained.

In the second embodiment, each divided surface 61A is formed into a convex-curved surface, but an envelope, interconnecting the divided surfaces 61A in an imaginary manner, is analogous in shape to a paraboloid, and therefore each divided surface 61A can be regarded generally as constituting part of a paraboloid, and the reflection characteristics of the reflector as a whole are not adversely affected. In contrast, at the region constituting the round corner portion 7, each divided surface 61A can much diffuse the bulb light in the right and left directions since the divided surface 61A is formed into the convex-curved surface, and the right-left light distribution characteristics, required for the turn signal lamp, can be satisfied by the round corner portion of a small area and hence by the turn signal lamp of a small size, and advantageously, this contributes to the small-size design of the vehicular lamp.

Figure 8:
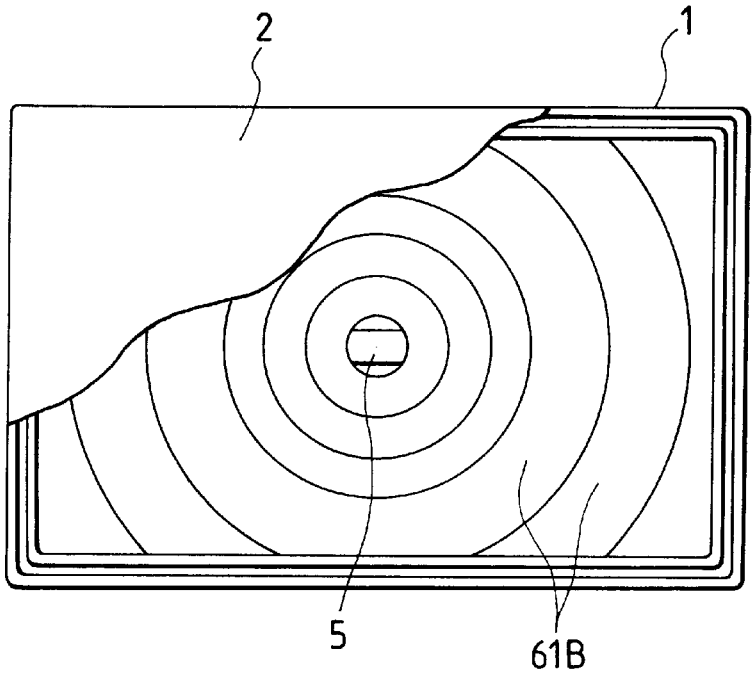
FIG. 8 is a front-elevational view of another embodiment of the invention, with a lens partly broken.
Figure 9:
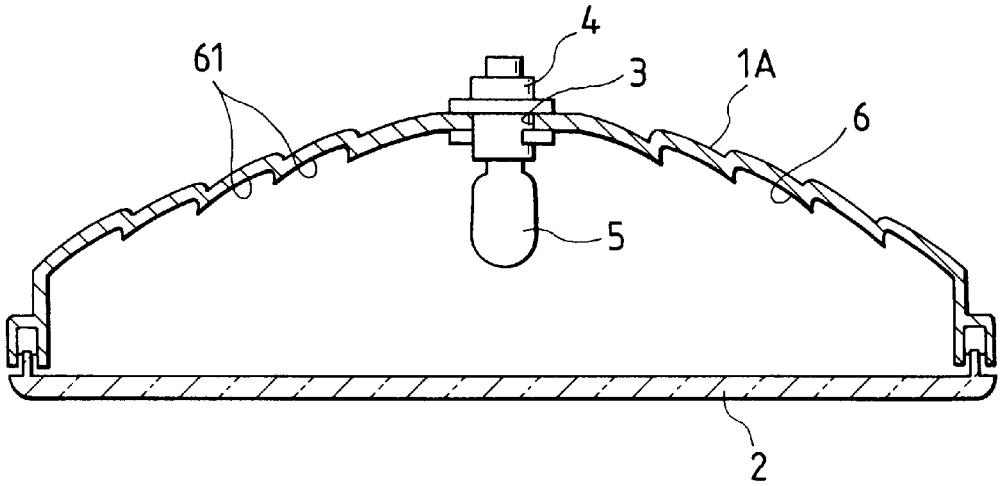
FIG. 9 PRIOR ART
FIG. 9 is a horizontal cross-sectional view of a conventional vehicular lamp.
Figure 10A:
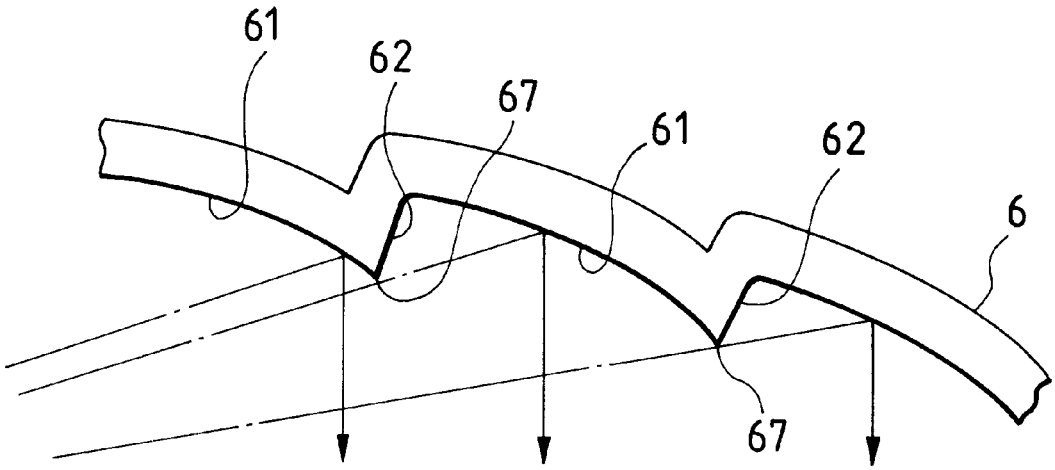
FIG. 10A PRIOR ART
FIG. 10A is a view showing a condition of reflection of light by a portion of a reflector of the vehicular lamp of FIG. 9.
Figure 10B:
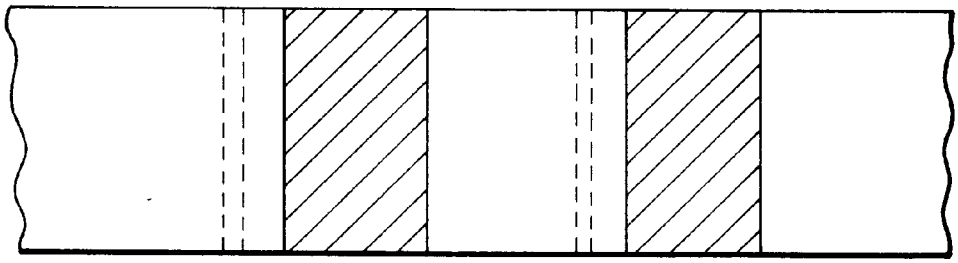
FIG. 10B PRIOR ART
FIG. 10B is a view showing a condition of observation from the front side.

In the above embodiments, although the reflective surface of the reflector is divided into the divided surfaces in the right-left direction of the vehicular lamp, there may be provided a construction as shown in FIG. 8 (which is a front-elevational view), in which a reflective surface is divided into concentric regions about a bulb 5, and divided surfaces 61B are constituted respectively by the annular portions or part thereof. In this structure, the thickness of the lamp body is reduced so as to achieve the thin design of the vehicular lamp, and also annular bright and dim illuminating portions will not be formed by the divided surfaces, and there can be obtained the vehicular lamp in which the desirable light distribution characteristics can be obtained, and the excellent appearance can be obtained.

The present invention is not limited to the type of vehicular lamps in which the lamp body and the reflector are formed integrally with each other, but can be applied also to the type of vehicular lamp in which an independent reflector is provided in a lamp body, and in this case the reflector is constituted by a plurality of divided surfaces as in the above embodiments, and by doing so, the thin design of the vehicular lamp can be achieved, and the appearance can be improved. The present invention is not limited to the parabolic reflector, but can be applied to any other suitable vehicular lamp in so far as a reflective surface is constituted by a plurality of divided surfaces.

As described above, in the present invention, the reflective surface of the reflector is divided into the plurality of regions, and each of the divided surfaces is formed by a paraboloid, and the boundary portion between any two adjacent divided surfaces is formed as the diffusion surface. Therefore, the formation of bright and dim stripes at the boundary portion between the divided surfaces is suppressed by the light diffusion due to the reflection of the light by this diffusion surface, thereby improving the light distribution characteristics and the appearance. Each of the divided surfaces and its adjoining divided surface can be made continuous with each other by the continuous, gently, convex-curved surface, and the diffusion surface is formed at the distal end portion of the convex-curved surface, and with this construction the formation of the bright and dim stripes can be more effectively prevented by the diffusion of the reflected light, and advantageously, the light distribution characteristics and the appearance can be further improved.

What is claimed is:

1. A vehicular lamp, comprising:

a cup-shaped lamp body having a front opening;

a lens coupled to said front opening of said lamp body;

a light source secured to said lamp body; and a reflector formed in said lamp body, said reflector comprising a reflective surface divided into a plurality of regions, each of said divided regions of said reflective surface having a form of a paraboloid, and a boundary portion located between each of two adjacent regions of said reflective surface, at least one of the boundary portions comprising a light diffusion surface.

2. The vehicular lamp according to claim 1, wherein each of said divided surfaces and its adjoining divided surface are made continuous with each other by a continuous, gently, convex-curved surface, and said diffusion surface is formed at a distal end portion of said convex-curved surface.

3. The vehicular lamp according to claim 1, wherein said vehicular lamp is mounted at a corner portion of the vehicle, and a reflective surface region of said reflector for a round corner portion, extending along a side surface of the vehicle, is divided into the plurality of divided surfaces.

4. The vehicular lamp according to claim 1, wherein each of said divided surface is upwardly-downwardly extending, band-like, and curved into a parabolic shape in the upward-downward direction, and is separated in the right-left direction to form narrow bands, in such a manner that the focal distances of said divided surfaces gradually increase.

5. The vehicular lamp according to claim 1, wherein said diffusion surface is formed by forming mesh-like cuts in those portions of a mold for molding the lamp body corresponding respectively to said diffusion surfaces.

6. The vehicular lamp according to claim 1, wherein said diffusion surface is formed by boarding.

7. The vehicular lamp according to claim 1, wherein a part of said divided surfaces disposed on one side of the light source close to a side surface of the vehicle are rearwardly offset a larger amount than those divided surfaces disposed on the other side.

8. The vehicular lamp according to claim 1, wherein each of said divided surface is formed into a convex-curved surface, but an envelope, interconnecting said divided surfaces in an imaginary manner, is analogous in shape to a paraboloid.

9. The vehicular lamp according to claim 1, wherein the reflective surface of said reflector is divided in the right-left direction of the vehicular lamp.

10. The vehicular lamp according to claim 1, wherein the reflective surface of said reflector is divided into concentric regions about the light source, and said divided surfaces are constituted respectively by the annular portions thereof.

* * * * *